United States Patent [19]

Levine

[11] 4,214,681

[45] Jul. 29, 1980

[54] APPLICATING DEVICE

[76] Inventor: Abraham I. Levine, 26 Wilson Ave., Rowayton, Conn. 06853

[21] Appl. No.: 944,791

[22] Filed: Sep. 22, 1978

[51] Int. Cl.[2] ..... B05B 11/00; F04B 43/12

[52] U.S. Cl. ..... 222/214; 417/477

[58] Field of Search ..... 222/214, 252, 263, 325; 417/474, 475, 476, 477

[56] References Cited

U.S. PATENT DOCUMENTS

| | | | |
|---|---|---|---|
| 1,710,435 | 4/1929 | Shelburne | 222/325 |
| 2,668,637 | 2/1954 | Gilmore | 222/214 X |
| 2,694,984 | 11/1954 | Daniels | 417/477 |
| 3,011,684 | 12/1961 | Cornell | 222/214 |
| 3,386,630 | 6/1968 | Hanland | 417/477 X |
| 3,930,761 | 1/1976 | Barraclough | 417/476 |

FOREIGN PATENT DOCUMENTS

| | | | |
|---|---|---|---|
| 1064984 | 4/1967 | United Kingdom | 222/252 |

*Primary Examiner*—David A. Scherbel
*Assistant Examiner*—Frederick R. Handren
*Attorney, Agent, or Firm*—Arthur T. Fattibene

[57] ABSTRACT

A dispensing device which is adapted for applying predetermined amounts of a coating material, e.g., paint, to a wall or ceiling surface, which is stored or supplied from a container which is remotely disposed from the point of application. The dispensing device includes a dispensing head connected to a supply of coating material by a hose or conduit. The dispensing head is hand-held and includes a rotor which operates to periodically squeeze the coating material from the hose so as to dispense the material as needed. To assist in dispensing the coating material through an extensive length of hose, the paint supply is pressurized.

7 Claims, 2 Drawing Figures

APPLICATING DEVICE

PROBLEM

In painting, and in particular, house painting, a considerable amount of time and energy is expended by the maneuvers necessary to transfer the paint from a paint can to the wall or surface to be painted. The brushing of the paint onto a surface is required to be interrupted each time the brush runs dry and the brush being required to be frequently dipped in the paint. Thus brushing operation requires the painter to tap off the excess paint and then apply the brush to the surface for painting. Such maneuvers are fatiguing and exhausting, as well as time consumming. Such operation also requires the supply of paint to be close to the painter. As a result, the exposed paint container is also subjected to being inadvertently spilled or accident proned.

OBJECTS

An object of this invention is to provide a dispensing device for dispensing a coating material to a given surface in a manner whereby the supply of coating material is remotely disposed from the point or place of application.

Another object is to provide for a dispensing device which is capable of effecting controlled dispensing of a coating material to a given surface in a simple and expedient manner.

Another object is to provide a dispensing device which is capable of pumping and dispensing a fluent material as needed to a given surface from a supply source remotely positioned from the surface to be coated.

BRIEF SUMMARY OF THE INVENTION

The foregoing objects and other features and advantages are attained by a dispensing device which comprises a dispensing head which is connected by a hose or conduit to a supply of material remotely disposed therefrom. The dispensing head includes a housing having a curvilinear wall portion. A rotor is rotatably mounted within the housing. Connected to the rotor are several radially extended arms to which a pressure roller is rotatably journalled. Threaded through the housing contiguous to the curvilinear wall is a portion of the conduit through which the coating material or paint is dispensed. The arrangement is such that the rollers contiguous the conduit portion will function to squeeze the material throughout the hose as the rotor is rotated and thereby effect the dispensing of the material accordngly onto the given surface to be coated. A drive is operatively connected to the rotor to effect the drive thereof. The drive comprises a unidirectional ratchet drive which is operatively connected to an operating handle; the drive being activated each time the handle is actuated. To assist the movement of the material through an extended hose length, a pressure chamber is provided for use with the material supply to impose onto the supply of material a positive pressure or head.

FEATURES

A feature of this invention resides in the provision of a paint dispenser having a dispensing head for pumping and dispensing predetermined amounts of coating material directly onto a surface to be painted or coated.

Another feature resides in the provision of a dispensing head operatively associated with a flexible conduit wherein the dispensing of the material through the conduit is effected by incremental displacement of the pressure rollers along a length of the flexible conduit.

Another feature of the invention resides in the provision of a pressurizing chamber for subjecting the supply of material to be dispensed to a positive pressure.

Other features and advantages will become more readily apparent when considered in view of the drawings and specification in which.

DETAILED SPECIFICATION

Figures 1, 2:
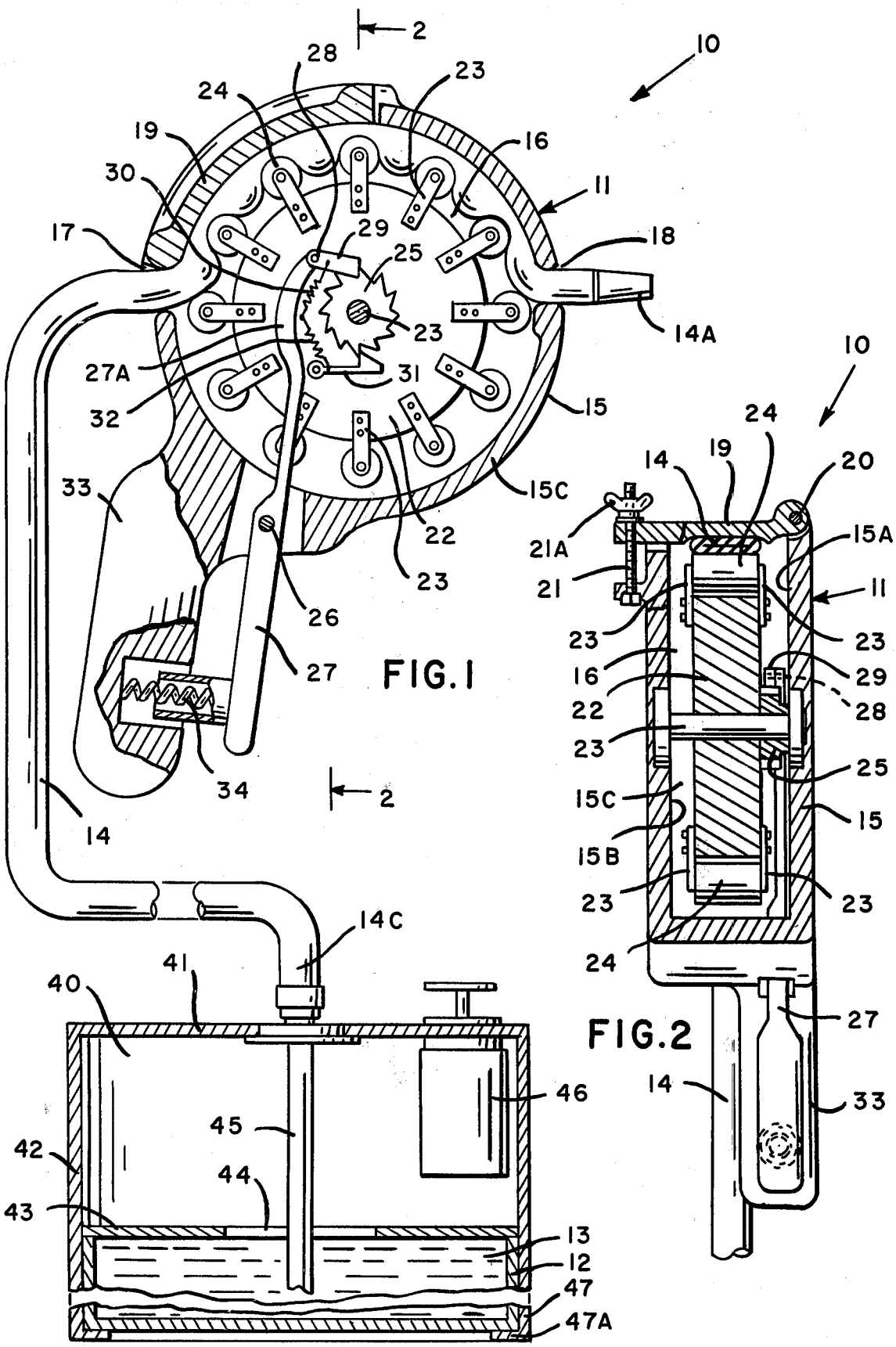
FIG. 1 is a side elevation view of the dispensing device embodying the invention having parts shown in section.
FIG. 2 is a sectional view taken along line 2—2 on FIG. 1.

Referring to the drawings there is shown a dispensing device 10 embodying the present invention which is particularly adapted to pumping and dispensing a coating material, e.g., paint, to a surface to be coated, as needed, from a supply source which is remotely disposed. The dispensing device 10 includes a dispensing head 11, which can be hand-held by a painter or the like, and which is connected to a source of supply 12 by a flexible hose or conduit 14. It will be noted that the source of supply 12 can be a conventional can or container in which the coating material; e.g., paint 13 is sold.

The dispensing head 11 comprises a housing 15 which is defined by a pair of opposed side walls 15A and 15B which are secured in spaced apart relationship by a curvilinear end wall 15C. Accordingly, the side walls 15A and 15B together with the curvilinear end wall 15C define a housing having a generally circular internal chamber 16. Formed in the end wall 15C is an inlet opening 17 and an oppositely disposed outlet opening 18, through which a portion of a flexible hose or conduit 14 is threaded. As best seen in FIG. 1, the discharge end 14A of the flexible hose or conduit 14 defines a nozzle through which the coating material or paint 13 is discharged, as will be hereinafter described. The portion of the hose threaded through chamber 16 is inserted through the inlet opening 17 and is placed contiguous the upper curvilinear portion of the end wall with the discharge end 14A extended through opening 18. To facilitate the positioning of the hose 14 in chamber 16 as described, a portion 19 of the end wall 15C is hingedly connected to a side wall 15A as at 20 to define an access opening into the chamber 16. A screw fastener 21 is provided to secure the closure portion 19 of the end wall in a closed position. The hinged portion 19 also functions so as to apply a compressive force on the hose 14, as shown in FIG. 2, and the screw fastener functioning to vary the compressive force being applied onto the hose by the degree with which the screw nut 21A is tightened.

Rotatably disposed within chamber 16 of housing 15 is a rotor 22. The rotor 22 is rotatable about an axis or pin 23 journalled between end walls 15A and 15 B. Connected to the rotor 22 are a plurality of radially extending arms 23 which are circumferentially spaced therearound. Connected to the extended end of arms 23 is a pressure rollers 24. It will be noted that the pressure rollers 24 are spaced from the end wall 15C. As best seen in FIG. 1, the portion of the flexible tube or hose threaded through the housing is disposed between the upper portion of the chamber contiguous the curvilinear end wall 15C and the series of rollers 24 adjacent thereto. The arrangement is such that the rollers 24 are disposed in rolling engagement with the portion of the hose or conduit 14 adjacent thereto so as to effect a squeezing action on the tube when the rotor 22 is rotated as will be hereinafter described. The compressive force thus exerted on the flexible tube or hose by the end wall 15C and the rollers 24 cause the hose or tube to define bulges or pockets 14B between the spaced apart rollers.

To effect controlled rotation of the rotor 22, a drive means is operatively connected thereto. As shown in FIGS. 1 and 2, the drive means comprises a ratchet 25 which is connected to the rotor 22. Pivotally connected to the housing 15 by a pin 26 is a handle or operator 27; the upper end of which extends into chamber 16. Connected to the upper end 27A by a pivot pin 28 is a ratchet pawl 29. The pawl 29 is positioned to act upon the ratchet 25 to effect an incremental displacement of the ratchet 25 and rotor 22 each time the handle 27 is displaced. A spring 30 maintains a bias on pawl 29 to effect engagement between the pawl 29 and ratchet 25. Pivoted to the housing is a back check pawl 31 which is under the tension of spring 32. The arrangement is such that the rotor 22 is incrementally rotated, in a step by step manner each time the actuating means or handle 27 is pressed.

As shown in FIG. 1, the housing 15 is provided with an extension or handle portion 33 which permit the dispensing head 11 to be hand-held. The ratchet handle 27 is disposed opposite the housing handle portion 33 so that an operator can grip and hold the dispensing head in one hand. Thus by the operator exerting a squeezing action on handle portion 33 and 27, the rotor 22 can be actuated as desired.

The other end of the hose or conduit is placed into the paint supply 13 which can be remotely disposed. It will be noted that the free end of the hose or conduit can be simply placed into the paint supply. Thus to dispense the paint, the operator need only to squeeze handle 27 to effect the drive of rotor 22, and thereby cause the pressure rollers 24 to squeeze and pump the paint from the supply 12 to the nozzle 14A. As the paint is applied to a surface, the painter with his other hand is free to spread the dispensed paint by either brush or roller. In this manner, the painter would have readily available the paint or coating material whenever needed, and thereby avoid the time and energy heretofore required to repeatedly dip the brush or roller in a paint supply. The procedure herein described thus eliminates a tedius and time consumming problem heretofore encountered in painting.

To facilitate the return of the handle 27 upon each squeezing action of the handle, a spring 34 is interposed between handle portions 33 and 27.

In the event the length of the conduit or hose 14 is so extensive, that the pumping or squeezing action imparted by the pressure rollers 24 is insufficient to provide the necessary head or difference in pressure to pump the paint from its suply source; a means is provided to enhance the flow of paint or coating 13 from its source of supply to the dispensing head. As shown in FIG. 1, the means comprises a pressure chamber 40 which defined by a top wall 41 and a circumscribing end wall 42; and a bottom wall 43. The bottom wall 43 is provided with an opening 44 which is adapted to be placed into communication with the interior of a paint can or supply 12. Connected to the top wall 41 is a tube 45 which extends through opening 44 and into the paint supply 13. The end 14C of hose 14 is secured to an extended end of tube 45. An air pump 46 is associated with chamber 40 so that a positive head of pressure can be applied to the paint supply when the chamber 40 is attached thereto.

In accordance with this invention, the bottom wall 43 of the pressure chamber 40 is formed of a suitable compressible material so that when placed over a paint can 12, a fluid pressure tight seal is defined therebetween.

Thus when a head of pressure is built up, no leakage will occur between chamber 40 and can 12.

To facilitate attachment of chamber 40 to can 12, the chamber 40 is provided with a series of leg members or clamping legs 47 which may be rendered ajustable so as to grip and secure the can 12 between the inturned portions 47A of legs 47 and the bottom wall 43 of chamber 40.

The head of pressure to which the paint supply 13 is subjected, when the pressure chamber is utilized, will thus feed the paint by pressure to the dispensing head, and the actuation of the handle 27 effects the displacement of rollers 24 necessary to squeeze the coating material through the discharge nozzle 14. Thus with the pressure chamber 40 assist, the paint supply can be located at a considerable distance from the point of use.

It will be understood that the opening 44 in the bottom wall 43 of the pressure chamber 40 is sized so that the chamber 40 can be readily adapted for use with various diameter containers.

While the invention has been described with respect to a particular embodiment thereof, it will be readily appreciated and understood that variations and modifications may be made without departing from the scope or spirit of the invention.

What is claimed is:

1. An applicating device for applying a fluent coating material to a surface to be coated by said material comprising:

a conduit means having one end adapted to be disposed in communication with a supply of the coating material to be applied to a surface, a dispensing means connected to the other end of said conduit, said dispensing means including means to convey predetermined amounts of said coating material through said conduit from a supply source to said other end of said conduit whereby the material is dispensed onto a surface, said dispensing means including a housing having a curvilinear inner wall surface, a rotor rotatably journalled in said housing, a plurality of radially extending arms connected to said rotor, said arms being circumferentially spaced about said rotor, pressure rollers rotatably journalled to the extended ends of said arms, said rollers being spaced from said inner wall surface of said housing, said housing having an inlet opening and an outlet opening, said conduit means being threaded through said inlet opening and outlet opening whereby said other end of said conduit means extends through said outlet opening, and the portion of said conduit means extending between said inlet and outlet openings being disposed contiguous the curvilinear inner wall of said housing and between said inner wall and adjacent rollers, and an actuating means operatively associated with said rotor for effecting the drive of said rotor so that said rollers effect a squeezing action on said conduit means when said rotor is activated to dispense said coating material from the outlet end of said conduit means, said actuating means including a unidirectional drive, wherein said drive comprises a ratchet connected to said rotor, an operating handle pivoted to said housing, a pawl pivoted to the end of said lever opposite said ratchet, and spring means biasing said pawl into operative engagement with said ratchet whereby said rotor is incrementally driven as said lever is actuated.

2. An applicating device as defined in claim 1 and including a detent pawl operatively associated with said ratchet to function as a back check.

3. An applicating device as defined in claim 2 wherein said curvilinear inner wall surface includes a moveable portion to facilitate access to the interior of said housing for threading said conduit means therethrough.

4. An applicating device as defined in claim 1 and including means for pressurizing the supply of material.

5. A paint feeder for dispensing paint onto a surface to be painted comprising:

a container adapted to contain a supply of paint, a dispensing head, said dispensing head being remotely disposed from said container, a conduit means, said conduit means having one end disposed into the paint supply in said container, and having its other end defining the dispensing nozzle of said dispensing head whereby said paint is conveyed from said container to said dispensing nozzle as said dispensing head is operated, sad dispensing head comprising a housing having a curvilinear wall portion, a rotor rotatably journalled in said housing, a plurality of radially extended arms circumferentially spaced about said rotor, a roller rotatably journalled to the extended end of each of said arms, said rollers being disposed contiguous to said curvilinear wall, said conduit means having a portion thereof disposed between said curvilinear wall and rollers adjacent thereto, a drive means for effecting rotation of said rotor whereby rollers force the paint through said conduit portion disposed between said curvilinear wall and said adjacent rollers, said drive means includes a ratchet connected to said rotor, a lever pivoted to said housing, a pawl connected to one end of said lever, said pawl being in engagement with said ratchet to effect the drive thereof when said lever is actuated.

6. A paint feeder as defined in claim 5 wherein said housing includes a handle portion opposite said lever, and a spring means disposed between said handle portion and lever for normally biasing said lever from said handle portion.

7. A paint feeder as defined in claim 5 and including means for pressurizing said paint container.

* * * * *